United States Patent [19]

Doucet et al.

[11] Patent Number: 4,601,323

[45] Date of Patent: Jul. 22, 1986

[54] DUAL SLIDE CASTING OR MOLDING MACHINE

[75] Inventors: Maurice Doucet, St. Leonard; Pierre Lamy, Chomedey, both of Canada

[73] Assignee: Techmire Ltee., Quebec, Canada

[21] Appl. No.: 712,741

[22] Filed: Mar. 18, 1985

[30] Foreign Application Priority Data

Mar. 8, 1985 [CA] Canada ..... 476,062

[51] Int. Cl.[4] ..... B22D 17/00; B22D 17/26; B22D 33/04

[52] U.S. Cl. ..... 164/312; 164/341; 164/342

[58] Field of Search ..... 164/312, 341, 342, 137

[56] References Cited

U.S. PATENT DOCUMENTS

| | | | |
|---|---|---|---|
| 1,696,690 | 12/1928 | Rindsberg . | |
| 2,254,295 | 9/1941 | Kohl et al. . | |
| 2,521,520 | 9/1950 | Jancura . | |
| 2,706,840 | 4/1955 | Hethey . | |
| 2,947,045 | 8/1960 | Goldhamer | 164/312 |
| 3,103,701 | 9/1963 | Calchera et al. . | |
| 3,468,367 | 9/1969 | Bauer | 164/341 |
| 3,547,184 | 12/1970 | Koch | 164/312 |
| 3,757,850 | 9/1973 | Diez et al. | 164/309 |
| 4,261,414 | 4/1981 | Frenette et al. | 164/316 |

FOREIGN PATENT DOCUMENTS

| | | | |
|---|---|---|---|
| 613674 | 1/1961 | Canada | 164/312 |
| 821451 | 8/1969 | Canada . | |
| 823578 | 9/1969 | Canada . | |
| 830362 | 12/1969 | Canada . | |
| 918872 | 1/1973 | Canada . | |
| 919872 | 1/1973 | Canada . | |
| 932917 | 9/1973 | Canada . | |
| 1442795 | 7/1976 | United Kingdom | 425/DIG. 227 |

*Primary Examiner*—Nicholas P. Godici
*Assistant Examiner*—Samuel M. Heinrich
*Attorney, Agent, or Firm*—Parkhurst & Oliff

[57] ABSTRACT

A machine for injection molding or die casting includes a main machine base with an injection unit mounted on the rear face and a mold guideway mounted on the front face. An aperture in the main machine base and a corresponding one in the base of the guideway provides for the nozzle of the injection unit to engage molds carried in the guideway. The reciprocating of the molds toward and away from one another is due to the action of a totally enclosed toggle assembly interconnecting mold-carrying shanks with compression lever brackets mounted in the ends of the guideway, actuators being located centrally of guideway ends and linked to the toggle assembly. Position adjusters are incorporated for adjusting the location of the injection unit on the rear of the machine to position its nozzle relative to the molds.

2 Claims, 12 Drawing Figures

DUAL SLIDE CASTING OR MOLDING MACHINE

FIELD OF THE INVENTION

This invention relates to die casting or injection molding machines and in particular to a dual slide arrangement for such machines.

BACKGROUND OF THE INVENTION

Dual slide casting machines where two mold halves are carried by shanks that are driven towards and away from each other have been in existance for some time but, for a variety of reasons, have not found wide acceptance in the art. Mechanical problems have plagued many endeavors in such machines due to the complexity of their linkage arrangement with the means for reciprocating the shanks and the inaccuracies resulting therefrom.

The present invention provides a dual slide guideway which totally encloses a toggle assembly, the guideway being mountable on the front face of a machine base of the type as shown in our previous U.S. Pat. No. 4,261,414 issued Apr. 14, 1981. In that prior patent, the machine base supported a cross-type guideway on its front face and an injection assembly on its rear face.

The present invention is directed towards improving deficiencies in the prior art and to provide a dual slide arrangement which will have ease of servicing, flexibility in operation, an arrangement that can be readily adaptable to zinc or plastic injection systems and a mechanism that will provide injection on a mold parting line.

SUMMARY OF THE INVENTION

In accordance with the present invention, a machine for injection molding or die casting utilizes a heavy machine base with a generally central aperture therein and a dual slide guideway having a base plate, side walls and a front cover to totally enclose the toggle assemblies therein, the base plate of the guideway having a central aperture to coincide with that in the machine base. The guideway provides a greater access to the mold faces if molding over wire or over an insert is desired and if necessary, the guideway can be oriented vertically to provide means for the horizontal feeding of an extra part through the mold face area. Additionally, the arrangement lends itself to a gravity access-vertical location of a fed-in part and, due to the improved access to the mold face, it is a relatively easy task to apply a secondary operation such as internal threading devices etc.

The base plate of the guideway in combination with that of the machine absorbs all the energy of compression applied to the shanks and mold faces by the actuators of the machine.

The parting line location relative to an injection nozzle can be changed to the left, right or vertically, to meet various cavity requirements. The screw or nozzle assembly can be relocated on the rear face to meet such requirements.

According to a broad aspect, the invention relates to a machine for the injection molding or die casting of parts, the machine including a machine base, an injection unit mounted on the rear face of the machine base, an aperture located generally centrally thereof, a guideway mounted on the front face of the machine base, the guideway having a base plate, a top cover and side walls. The guideway encloses a pair of toggle assemblies, one disposed in each end of the guideway, each of the toggle assemblies comprising a pair of compression lever brackets secured to the ends of the guideway, shank members for carrying molds in the guideway, means interconnecting the compression lever brackets with the shank members, actuating means mounted in association with the compression lever brackets at each end of the guideway, and means operatively connecting the actuating means with the shank members so that operation of the actuating means causes reciprocation of the shank members and molds in the guideway.

According to a further aspect, the machine includes means for adjusting the position of an injection unit on the rear face of the machine base. The adjusting means consists of a first base member mounted on the rear surface of the machine base, a second base member mounted on the first base member, slotted apertures being provided in the second base member with securing screws passing through the slotted apertures and being threadably engaged in the first base member. First and second locating members are provided for positioning the second base relative to the first base. One of the locating members being located adjacent the top of the machine base and the other being located adjacent the side thereof, each said locating member comprising a threaded block secured to the second, moveable base member, a screw retaining block secured to the machine base and a screw located in the retaining block and engaging the adjacent threaded block so that rotation of the screws affects vertical or horizontal movement of the second, moveable base member and the injection unit being mounted on the second moveable base member.

DETAILED DESCRIPTION OF THE PREFERRED EMBODIMENT

Figure 1:
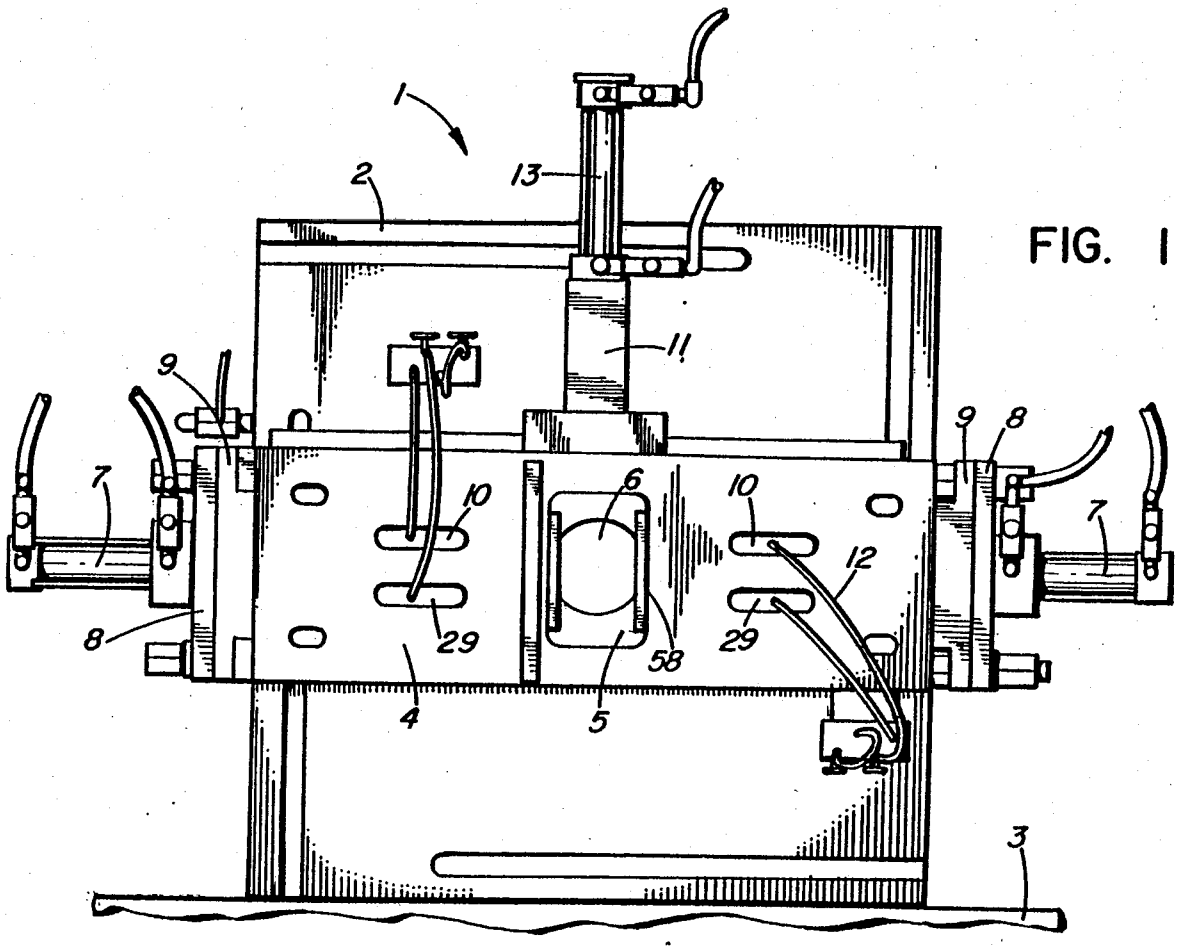
FIG. 1 is a frontal view of an injection molding or die casting machine incorporating the invention.
Figure 9:
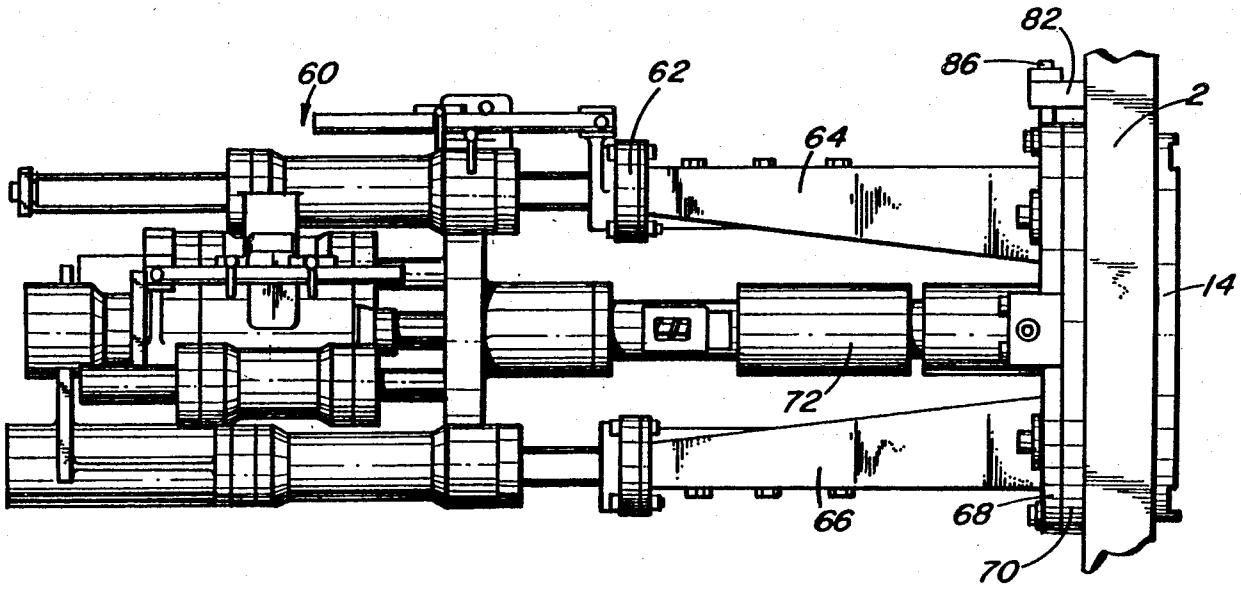
FIG. 9 is a plan view of an injection unit forming part of the invention.
Figure 10:
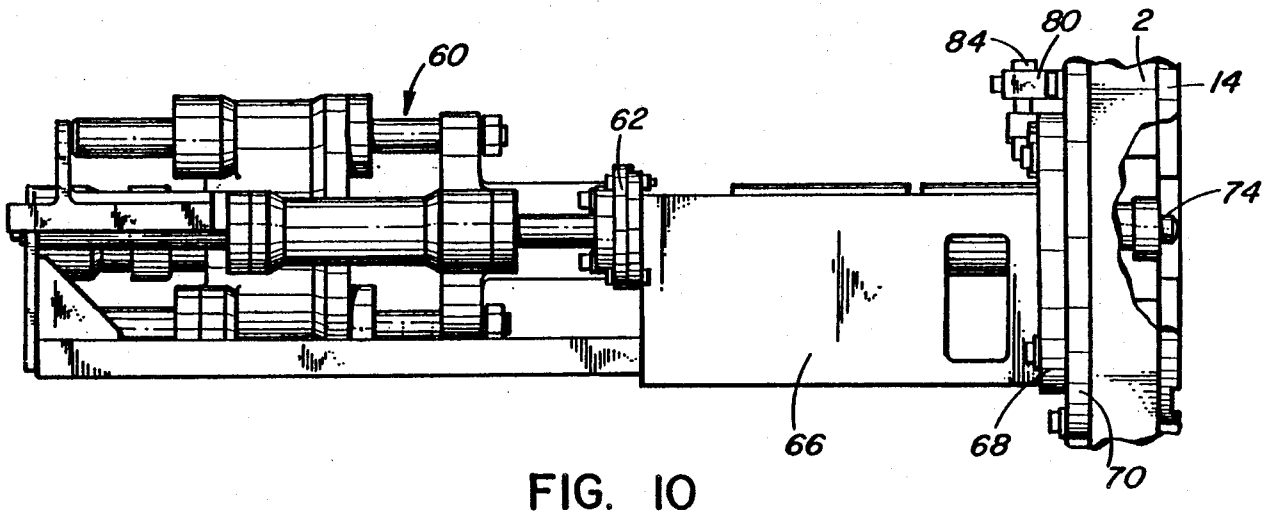
FIG. 10 is a side view of the injector unit shown in FIG. 9.
Figure 11:
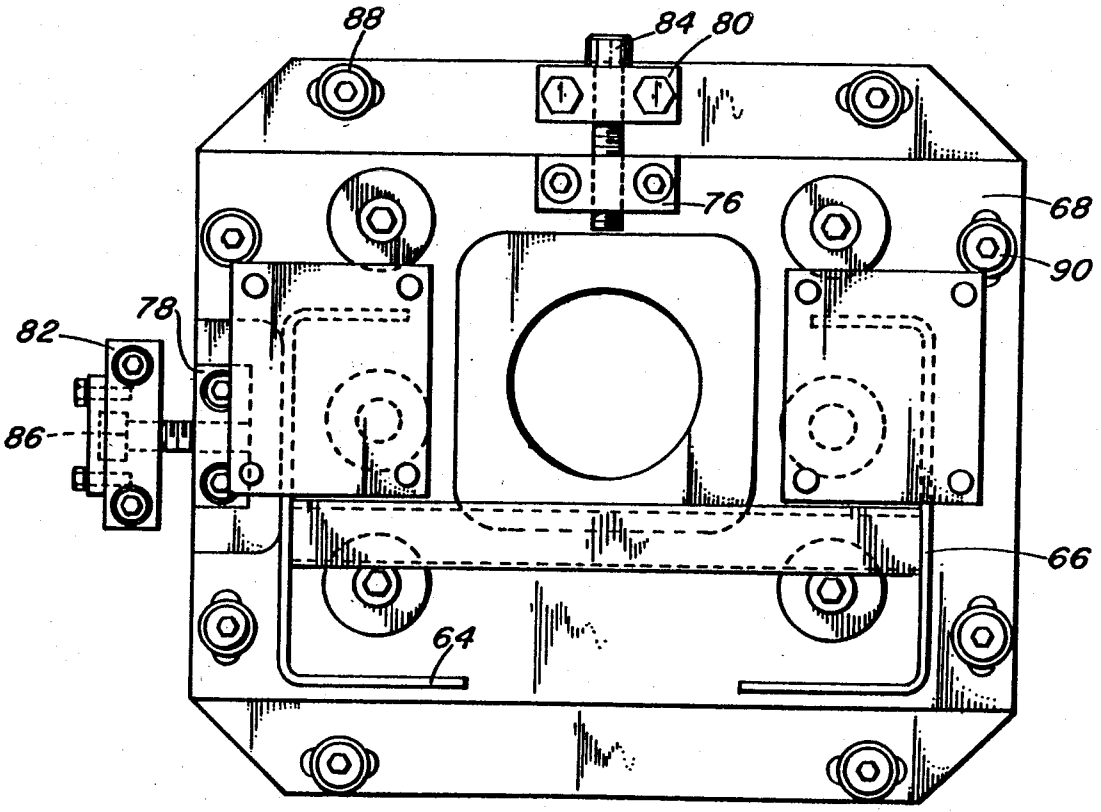
FIGS. 11 and 12 are end views of the injector unit.
Figure 12:
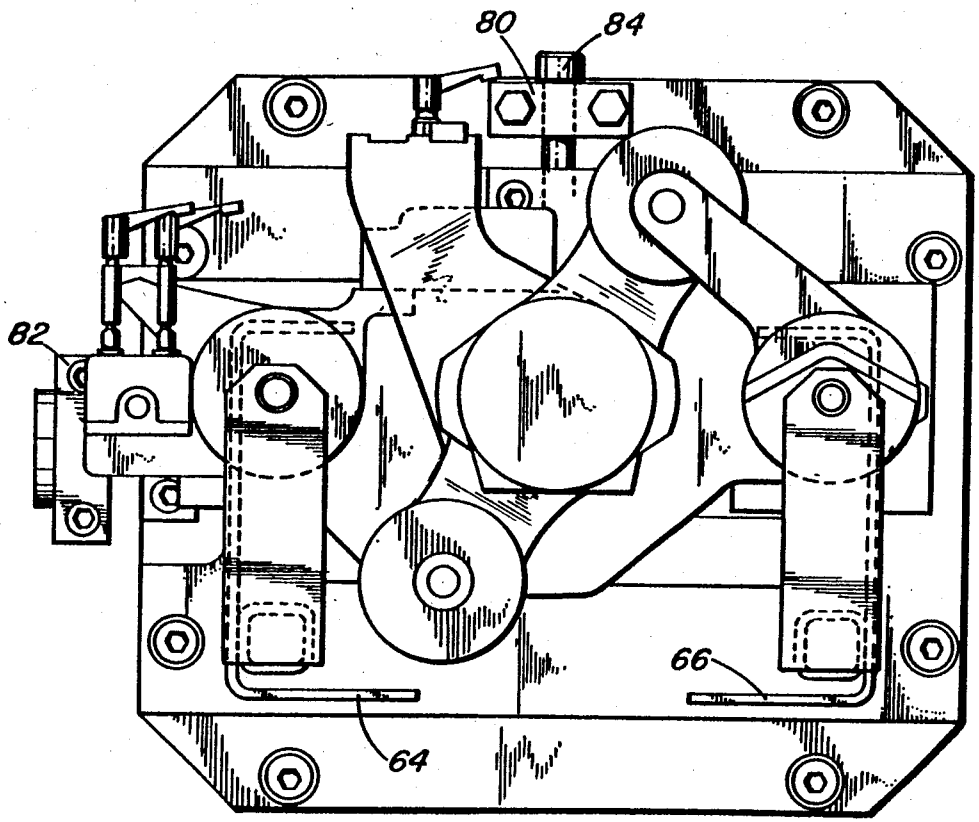

Referring to FIG. 1, there is shown a machine generally indicated at 1 for the injection molding or die casting of parts. If used in a die casting mold, the machine could utilize an injection system of the type shown in the aforementioned U.S. Pat. No. 4,261,414 of Apr. 14, 1981. As in the U.S. patent, the machine 1 incorporates a main or machine base 2 which preferably is pivotally mounted at its lower end to a frame structure 3. The injection unit, either of a die casting type or of a plastic injection type shown in FIGS. 9–11, is mounted on the rear face of the machine base 2. A guideway 4 is detachably mounted to the front face of the machine base 2, a central aperture 5 in the guideway coinciding generally with a similar aperture 6 in the machine base so that a nozzle of the injection unit may communicate with molds carried within the guideway 4.

Suitable actuators 7 are mounted in combination with platens 8 and compression lever brackets 9 in the ends of the guideway 4, shanks 10 carried in the guideway having their temperature controlled by a suitable cooling medium passed through lines 12 as shown. The arrangement of the guideway 4 is such that a secondary operation incorporating for example the use of a core mechanism 11 and its associate drive means 13, can be easily and quickly included in a casting operation.

Figure 2:
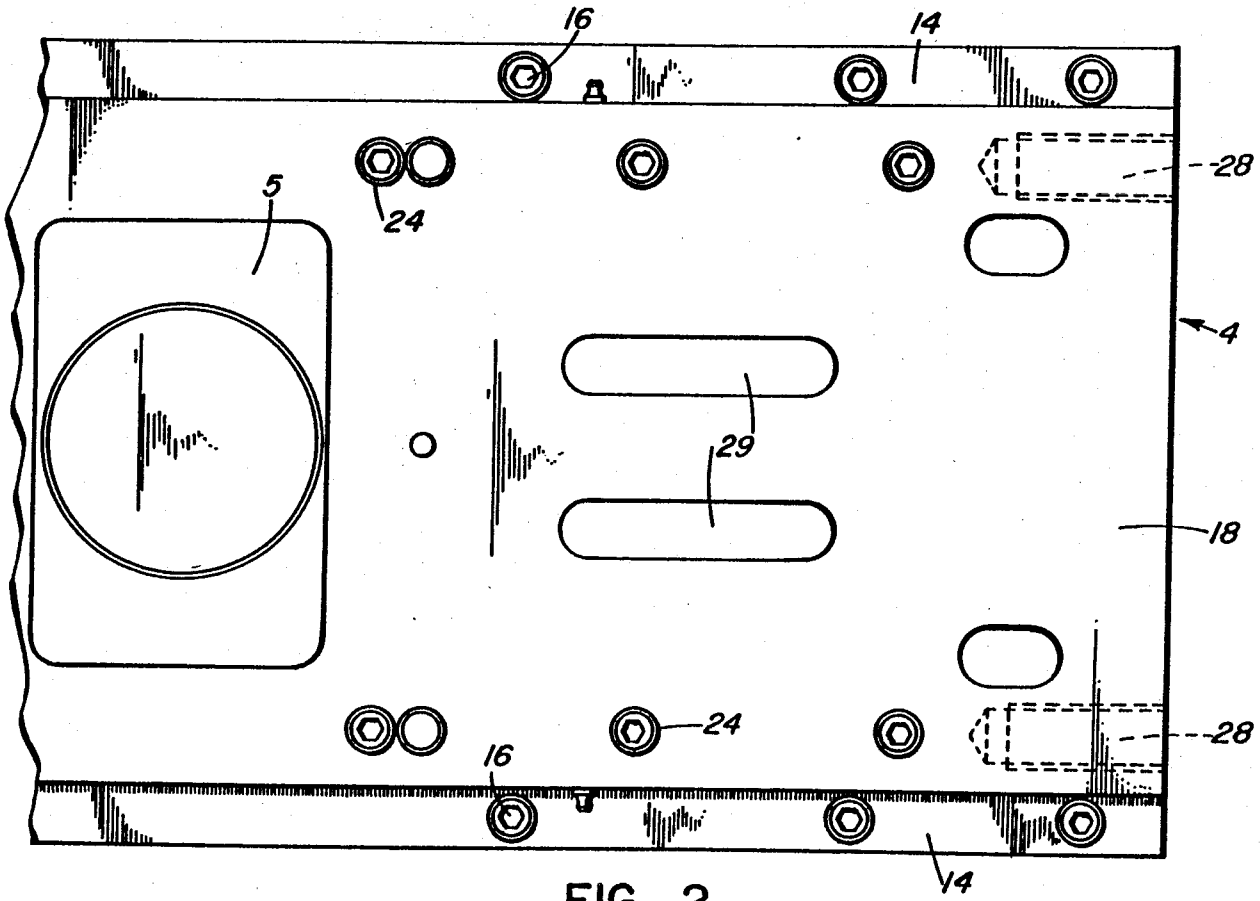
FIG. 2 is a frontal view of a portion of the guideway.
Figure 3:
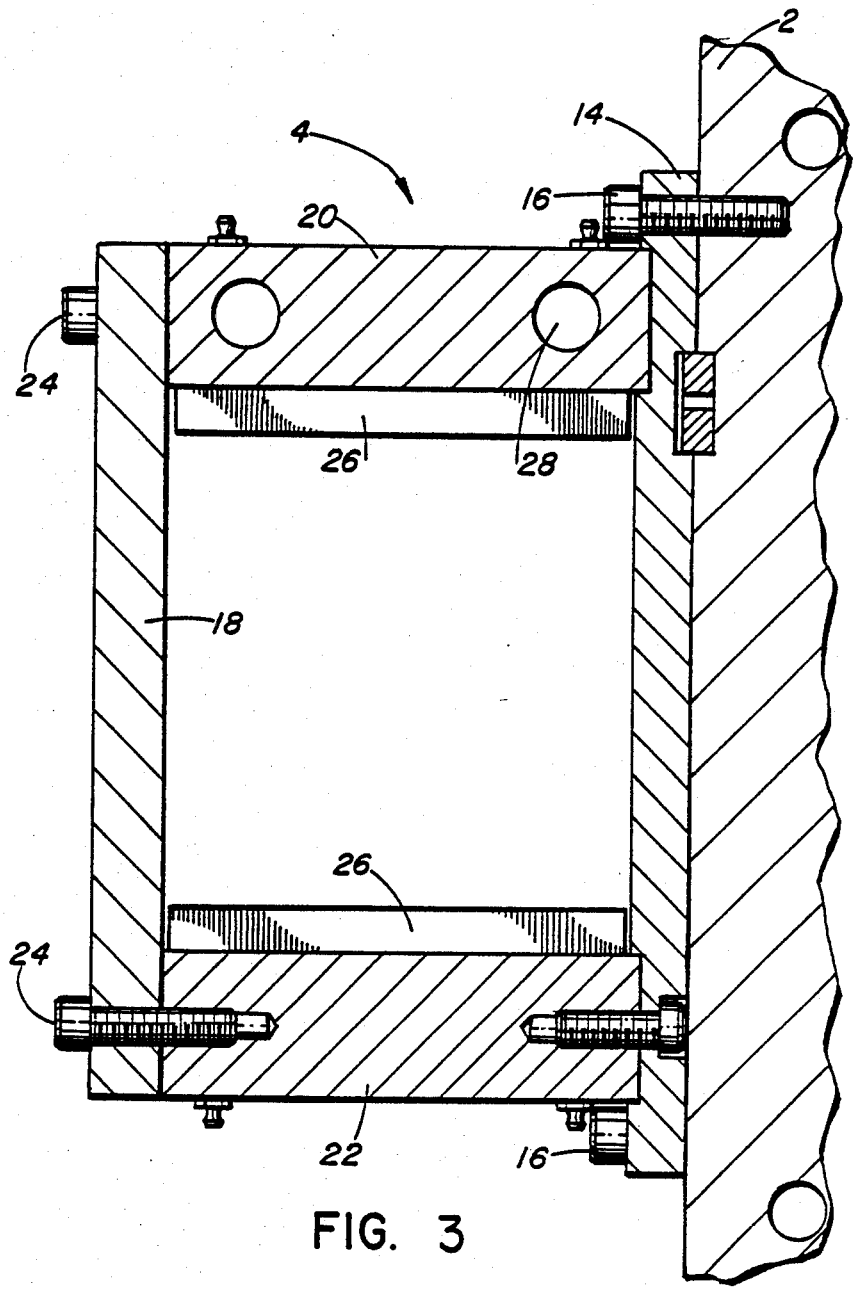
FIG. 3 is a cross-section of the guideway shown in FIG. 2.

Turning now to FIGS. 2 and 3 the guideway 4 is of box-like configuration and includes a base plate 14 secured by cap screws 16 to the main machine base 2 and the base plate 14 and a front cover 18 are secured to a top guide 20 and a bottom guide 22 by means of cap screws 24. Top guide 20 and bottom guide 22 both are provided with wear plates 26 as shown in FIG. 3. Front cover 18 is provided with slotted openings 29 (FIG. 2) for providing service to the reciprocating shanks 10 and the parts they carry.

The toggle assembly mechanism is shown in FIGS. 4 through 8 inclusive.

Figure 5:
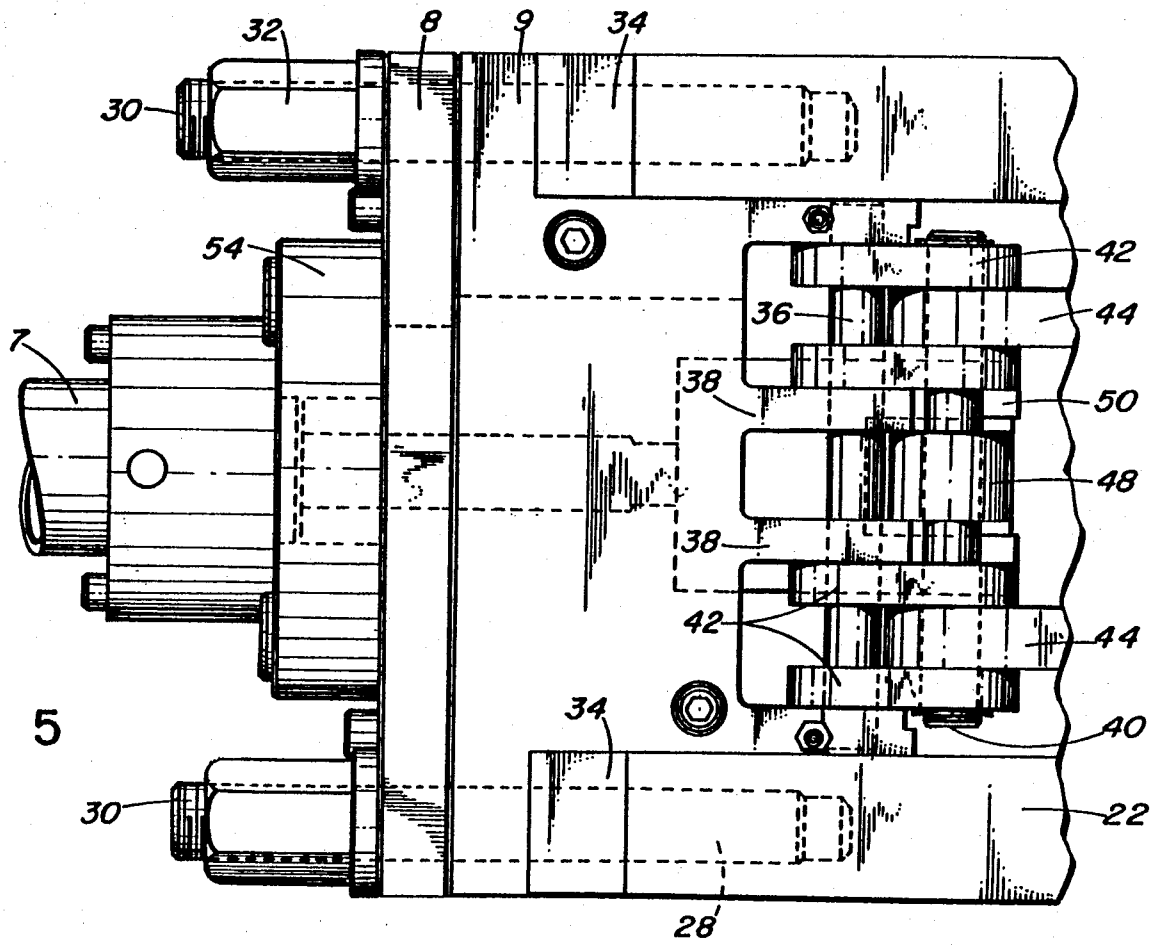
FIG. 5 is a frontal view of one end of the assembly of FIG. 4 mounted in the guideway.
Figure 6:
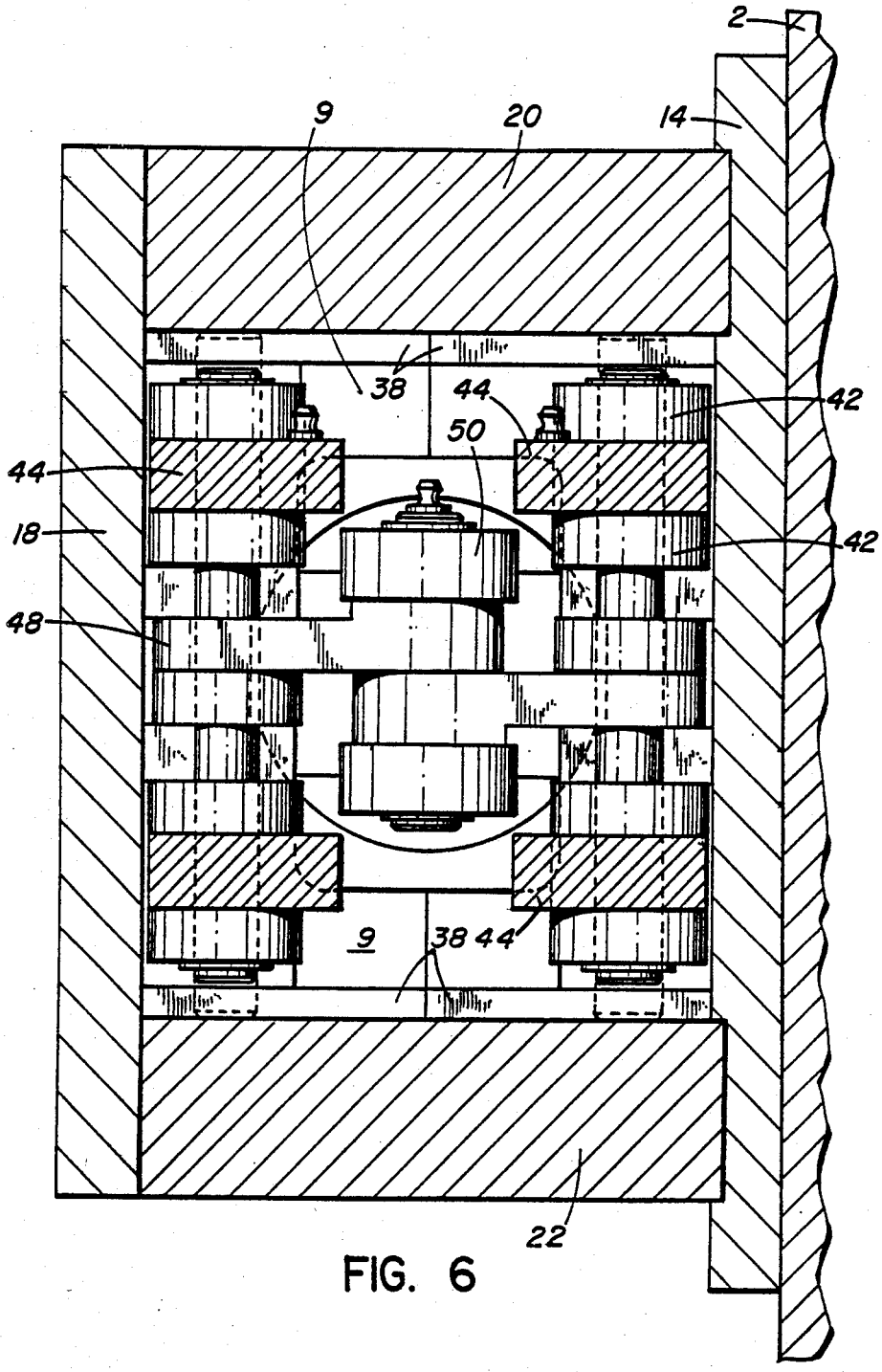
FIG. 6 is a cross-section of the assembly in the guideway.

The top guide 20 and bottom guide 22 are drilled as at 28, FIG. 3, for the reception of studs 30 (FIG. 5) which are used in mounting the compression lever brackets 9 and platens 8 in each end of the guideway 4. As shown in FIG. 5, when assembled, the compression lever brackets 9 and platens 8 are held in position by compression nuts 32 and, spacers 34 are utilized depending on the size of shank and molds being used in the operation at hand.

Figure 4:
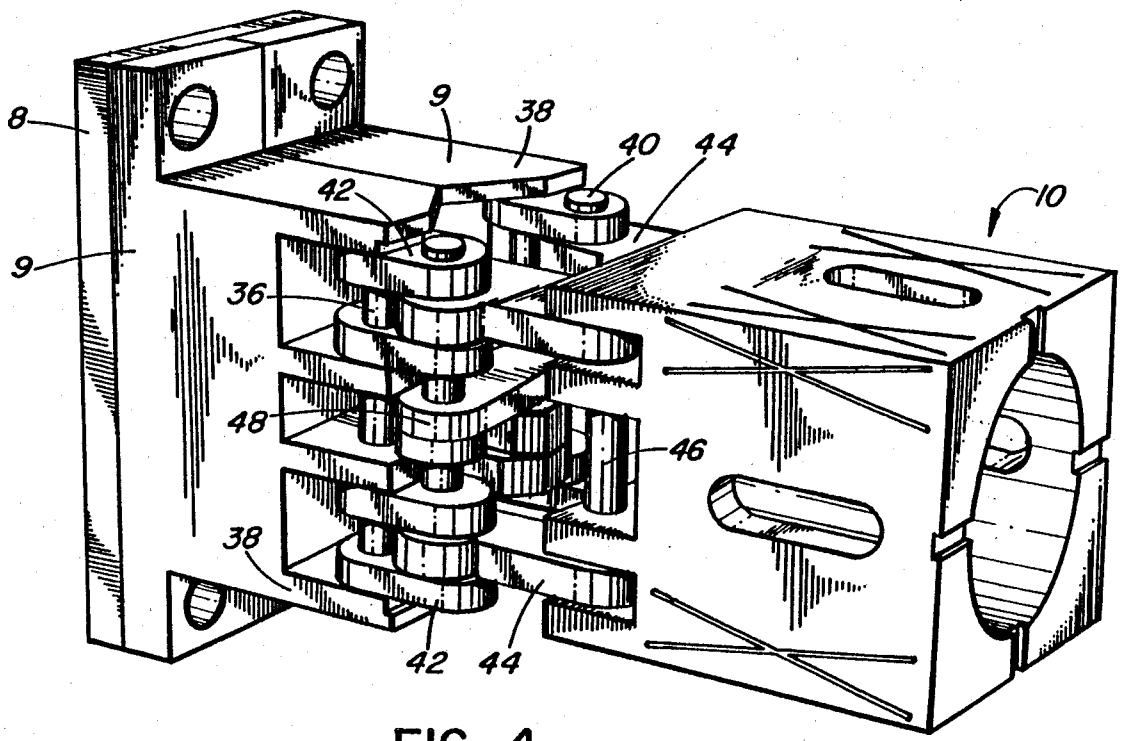
FIG. 4 is a perspective view of one of the toggle assemblies.

Referring to FIG. 4, it will be seen that the shank 10 is interconnected with the compression lever brackets 9 through a series of pivot pins and arms which make up the toggle arrangement.

A first pair of pins 36 are located in the extending arms 38 of the compression lever brackets 9. A second pair of pins 40 pivotally locate compression levers 42 which are pivotally connected at their other ends to the first pair of pins 36. Additionally, pins 40 also serve to locate one end of the compression arms 44 which are pivotally mounted at their other ends to a third pair of pins 46 located in the adjacent ends of the shank 10. Lastly, the second pair of pins 40 also pivot one end of links 48 which interconnect pins 40 with an end yoke 50 (FIG. 5) of an hydraulic cylinder 7 which is secured in the platen 8 by a cylinder mounting plate 54. The inner ends of links 48 are connected to the cylinder end yoke 50 by a single, centrally located pin 56 (FIG. 7).

Figure 7:
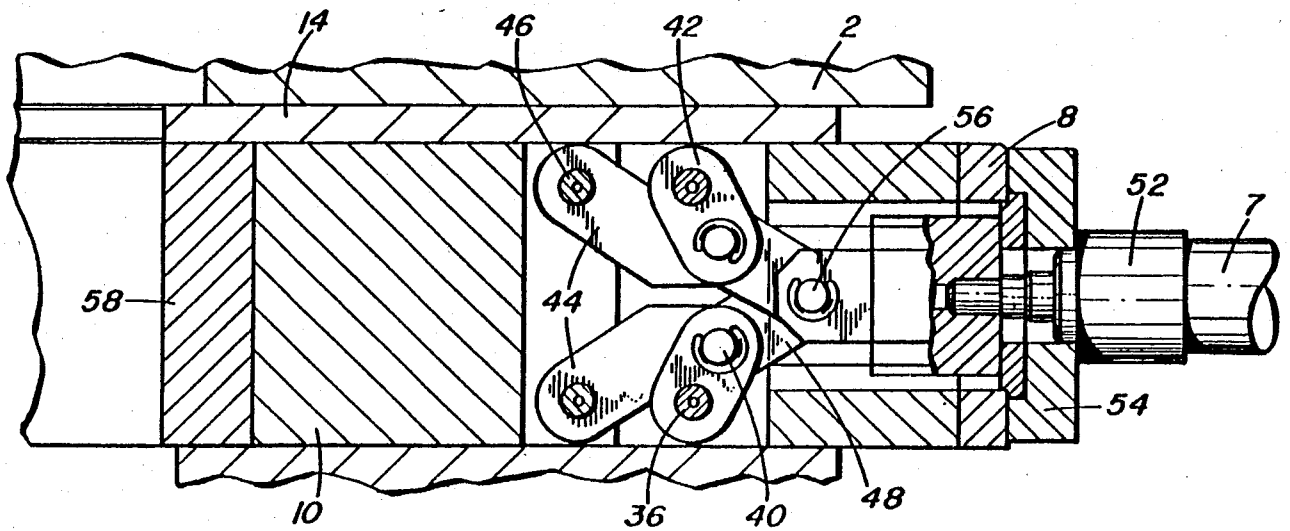
FIGS. 7 and 8 are top views, partly in section of the toggle assembly in open and closed positions respectively.
Figure 8:
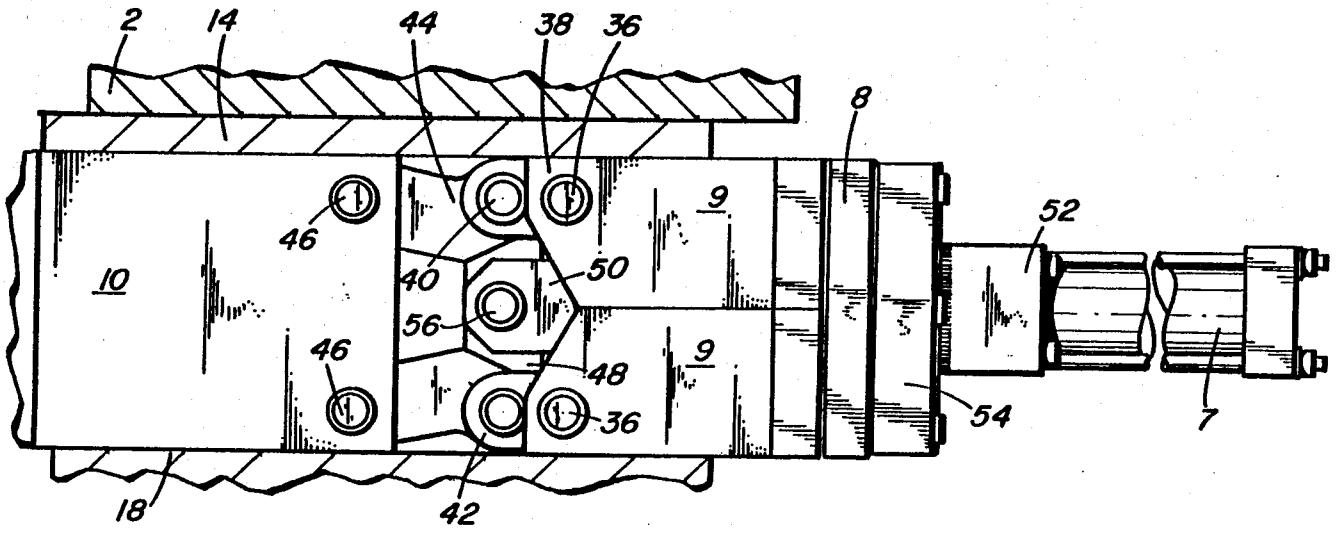

The result of this toggle arrangement is the operation shown in FIGS. 7 and 8. In FIG. 7, the shanks 10 and the molds 58 are drawn back from one another to open the apertures 5 and 6 (FIG. 1) and in FIG. 8, the actuator has forwarded the hydraulic cylinder end yoke 50, directing the shanks 10 and their molds 58 toward one another and in registry with one another subsequent to which an injection is made into the mold cavity.

The means for adjusting the position of an injector unit is shown in FIGS. 9 through 12 inclusive. Referring to FIGS. 9 and 11 in particular, the injector unit 60 is secured to a pair of mounting plates 62 which in turn are secured to a unit support in the form of a pair of elongated, channel shaped side members 64 and 66. These side members are secured to or form part of a moveable base member 68 which is secured to a second base member 70, both base members being mounted at the rear surface of the machine base 2. In the embodiment of the invention illustrated, the injector unit 60 includes a delivery conduit 72 terminating in a nozzle 74 (FIG. 10), located so as to engage the parting line of the molds 58 and the guideway 4.

In order to shift the location of the injector conduit 72 and nozzle 74 in order to meet various cavity requirements of the molds 58, two adjusting mechanisms are provided. One for moving the injector unit vertically and the other for moving the unit horizontally. As shown in FIG. 11, threaded blocks 76 and 78 are mounted on the top and side respectively of the base member 68. A screw retaining block 80 is mounted adjacent the thread block 76 and a further retaining block 82 is mounted adjacent the block 78. An adjusting screw 84 is located in the retainer 80 and a screw 86 is located in the retainer 82. It will be apparent that by slacking off the hold down bolts 88 and 90, adjustment of the bolts 84 and 86 will serve to move the injector unit either horizontally or vertically.

It will be appreciated that in place of the injector unit illustrated in FIGS. 9 through 11, a zinc injector unit of the type shown in U.S. Pat. No. 4,261,414 can be used in its place.

Those skilled in the art will appreciate the various features, characteristics and advantages of the present invention have been set forth herein or are readily realizable from the detailed description of this preferred embodiment. However, the disclosure is illustrative and various changes may be made for utilizing the principles of the present invention and falling within the scope of the invention as expressed in the appended claims.

The embodiments of the invention in which an exclusive property or privilege is claimed are defined as follows:

1. A machine for the injection molding or die casting of parts, said machine comprising:

(a) a machine base including a front face, a rear face at least one side face, a top portion and an aperture, said aperture being generally located centrally in said machine base;

(b) an injection unit mounted on the rear face of said machine base;

(c) a guideway having two ends mounted on the front face of said machine base, said guideway having a base plate, a front cover and sidewalls and said guideway enclosing a toggle assembly in each of said two ends, said toggle assembly comprising:

(i) a pair of compression lever brackets having end portions and a platen member secured to a first end of said two ends of said guideway;

(ii) shank means for carrying mold means in said guideway, said shank means having a first end located adjacent to said compression brackets;

(iii) actuating means mounted in association with said compression lever brackets and said platen at said first end of said guideway;

(iv) means for interconnecting said compression lever brackets with said shank means, including a first pair of pivot pins mounted in said end portions of said compression lever brackets;

(v) a second pair of pivot pins located substantially parallel to said first pair of pins, and pivotally connected to said first pair of pins by compression levers;

(vi) a third pair of pivot pins located substantially parallel to said first and second pairs of pins, said third pair of pins mounted in said first end of said shank means and compression arms pivotally connecting said second pair of pins with said third pair of pins; and (d) connecting means for operatively connecting said actuating means with said shank means, to permit reciprocation of said shank means and said mold means mounted on said shank means in said guideway, said connecting means comprising:

(i) a fourth pivot pin generally located centrally between of said first, second and third pairs of pivot pins;

(ii) means connecting said fourth pin to said actuating means;

(iii) link members for connecting pivotally said fourth pin to said second pair of pins;

(e) an aperture in the base plate of said guideway in communication with the aperture in said machine base.

2. A machine according to claim 1 further comprising:

(f) position adjusting means for adjusting the position of said injection unit on said rear face of the machine base, said position adjusting means comprising:

(i) a first base member mounted on said rear surface of the machine base;

(ii) a second moveable base member mounted on said first base member, wherein said moveable base member includes slotted apertures with securing screws passing through said slotted apertures for threadably engaging said first base member, said injection unit being mounted on said movable base member;

(g) first and second locating members for positioning said moveable base member relative to said first base member, said first locating member being located adjacent said top portion of said machine base and said second locating member being located adjacent said at least one side face of the machine base, wherein each locating member comprises:

(i) a threaded block secured to said moveable, base member; and (ii) a screw retaining block secured to said machine base and a screw located within said retaining block and engaging an adjacent threaded block such that rotation of said screw effects vertical or horizontal movement of said moveable, base member.

* * * * *

UNITED STATES PATENT AND TRADEMARK OFFICE

CERTIFICATE OF CORRECTION

PATENT NO. : 4,601,323

DATED : July 22, 1986

INVENTOR(S) : Doucet et al

It is certified that error appears in the above-identified patent and that said Letters Patent is hereby corrected as shown below:

In the drawings, Figure 11, the reference numeral 70 should be applied to the side of the base member (see Figures 9 and 10).

Column 4, line 15, change "and side respectively of the base" to --of the base member 68 and the side of the base member 70.--; line 16, delete "member 68."

Signed and Sealed this

Fourteenth Day of April, 1987

*Attest:*

DONALD J. QUIGG

*Attesting Officer*

*Commissioner of Patents and Trademarks*